US008671818B1

(12) United States Patent
Oliver

(10) Patent No.: US 8,671,818 B1
(45) Date of Patent: Mar. 18, 2014

(54) FIREARM DISCHARGE GAS FLOW CONTROL

(75) Inventor: Russell Oliver, Sandy, UT (US)

(73) Assignee: O.S.S. Holdings, LLC, Murray, UT (US)

( * ) Notice: Subject to any disclaimer, the term of this patent is extended or adjusted under 35 U.S.C. 154(b) by 157 days.

(21) Appl. No.: 13/308,235

(22) Filed: Nov. 30, 2011

Related U.S. Application Data

(60) Provisional application No. 61/418,294, filed on Nov. 30, 2010, provisional application No. 61/418,285, filed on Nov. 30, 2010, provisional application No. 61/418,311, filed on Nov. 30, 2010.

(51) Int. Cl.
*F41A 21/34* (2006.01)

(52) U.S. Cl.
USPC ..... 89/14.2; 89/14.4; 181/223

(58) Field of Classification Search
USPC ..... 89/14.2–14.4, 198; 181/223
See application file for complete search history.

(56) References Cited

U.S. PATENT DOCUMENTS

| | | | | |
|---|---|---|---|---|
| 748,157 | A | 12/1903 | Bouton | |
| 1,427,802 | A | 9/1922 | Goodwin | |
| 1,773,443 | A | 8/1930 | Wilman | |
| 2,589,738 | A | 3/1952 | Sedberry | |
| 4,501,189 | A | 2/1985 | Brandl et al. | |
| 5,029,512 | A | 7/1991 | Latka | |
| 5,164,535 | A | 11/1992 | Leasure | |
| 5,367,940 | A | 11/1994 | Taylor | |
| 5,433,133 | A | 7/1995 | La France | |
| 5,559,302 | A | 9/1996 | Latka | |
| 5,773,746 | A | 6/1998 | Vaden | |
| 6,385,891 | B1 | 5/2002 | Rabatin | |
| 6,948,415 | B2 | 9/2005 | Matthews et al. | |
| 7,073,426 | B1 | 7/2006 | White | |
| 7,207,258 | B1 | 4/2007 | Scanlon | |
| 7,353,740 | B1 | 4/2008 | Hoffman | |
| 7,676,976 | B2 | 3/2010 | Dueck et al. | |
| 7,891,284 | B1 | 2/2011 | Barrett | |
| 7,926,404 | B2 | 4/2011 | Brittingham | |
| 7,946,069 | B2 | 5/2011 | Dueck et al. | |
| 8,196,701 | B1 * | 6/2012 | Oliver | 181/223 |
| 8,516,941 | B1 * | 8/2013 | Oliver | 89/14.4 |
| 2009/0229454 | A1 | 9/2009 | Fluhr et al. | |
| 2010/0218671 | A1 | 9/2010 | Mayberry et al. | |
| 2011/0252952 | A1 | 10/2011 | McNeill et al. | |
| 2013/0263490 | A1 * | 10/2013 | Oliver | 42/90 |

* cited by examiner

*Primary Examiner* — Michael David
(74) *Attorney, Agent, or Firm* — Thorpe North & Western LLP

(57) ABSTRACT

A firearm discharge gas flow control device can comprise a first gas chamber fluidly connectable to a muzzle end of a firearm to allow a projectile to pass through and to receive a first portion of a discharge gas generated by firing the projectile. The device can also comprise a second gas chamber fluidly isolated from the first gas chamber and fluidly connectable to the muzzle end of the firearm to receive a second portion of the discharge gas, the second gas chamber having a flow control barrier to modify a flow of the second portion of the discharge gas.

21 Claims, 3 Drawing Sheets

FIREARM DISCHARGE GAS FLOW CONTROL

RELATED APPLICATIONS

This application claims the benefit of U.S. Provisional Application No. 61/418,294, filed Nov. 30, 2010 and of U.S. Provisional Application No. 61/418,285, filed Nov. 30, 2010 and of U.S. Provisional Application No. 61/418,311, filed Nov. 30, 2010, which are each incorporated herein by reference.

BACKGROUND

Discharging a firearm causes gases to be produced through rapid, confined burning of a propellant that accelerates a projectile. This typically creates a loud noise and a muzzle flash of light. Often, it is desirable to reduce the amount of noise and light produced by discharging a firearm. For example, military snipers or special operations forces personnel may require stealth to successfully complete missions. Suppressors, or silencers, are typically connected to the muzzle end of a firearm to temporarily capture gas that exits the muzzle. Some suppressor designs divert a portion of the discharge gas to a secondary chamber, such that the gas does not exit the suppressor by the same path as the projectile. The gas is released from the suppressor at a significantly reduced pressure. In general, the more gas a suppressor captures, the quieter the discharge sound of the firearm.

The presence of a suppressor, however, may increase the back pressure of the gas in the barrel of the firearm. Increased back pressure in the barrel can influence the firearm's operation. For example, some firearms are gas-operated and use discharge gas pressure in the barrel to reload the firearm. Thus, increasing gas back pressure in the barrel can increase forces acting on the reloading components.

Higher forces can reduce the service life of the reloading components. However, for certain ammunition types, reloading performance may improve with increased barrel back pressure. Additionally, certain tactical situations may dictate maximum suppression of the discharge of the firearm. This can result in maximum forces on the reloading components. Such a condition may be feasible for a limited number of firings before failure of the reloading components is likely to occur.

SUMMARY

Thus, there is a need for a firearm discharge gas flow control device that not only controls gas flow related to a suppressor, but is also adjustable for certain functional and tactical situations. In suppressor designs that vent discharge gas from a secondary chamber of the suppressor, there is an opportunity to control discharge gas flow from the secondary chamber in order to manage barrel back pressure and/or to adjust suppression of a discharge. Accordingly, a firearm discharge gas flow control device and associated methods are provided. Such a device can comprise a first gas chamber fluidly connectable to a muzzle end of a firearm to allow a projectile to pass therethrough and to receive a first portion of a discharge gas generated by firing the projectile. The device can further comprise a second gas chamber fluidly isolated from the first gas chamber and fluidly connectable to the muzzle end of the firearm to receive a second portion of the discharge gas, the second gas chamber having a flow control barrier to modify a flow of the second portion of the discharge gas.

Additionally, a firearm system in accordance with the principles herein can comprise a firearm and a firearm discharge gas flow control device. The firearm discharge gas flow control device can have a first gas chamber fluidly connected to a muzzle end of the firearm to allow a projectile to pass therethrough and to receive a first portion of a discharge gas generated by firing the projectile. The firearm discharge gas flow control device can further have a second gas chamber fluidly isolated from the first gas chamber and fluidly connected to the muzzle end of the firearm to receive a second portion of the discharge gas, the second gas chamber having a flow control barrier to modify a flow of the second portion of the discharge gas.

Furthermore, a method of controlling gas flow discharged from a firearm in accordance with the principles herein can comprise disposing a firearm discharge gas flow control device proximate to a muzzle end of a firearm. The method can further comprise firing a projectile from the firearm, wherein a first gas chamber of the device is fluidly connected to the muzzle end of the firearm to allow the projectile to pass therethrough and to receive a first portion of a discharge gas generated by firing the projectile, and a second gas chamber of the device is fluidly isolated from the first gas chamber and fluidly connected to the muzzle end of the firearm to receive a second portion of the discharge gas, the second gas chamber having a flow control barrier to modify a flow of the second portion of the discharge gas.

Figure 1A:
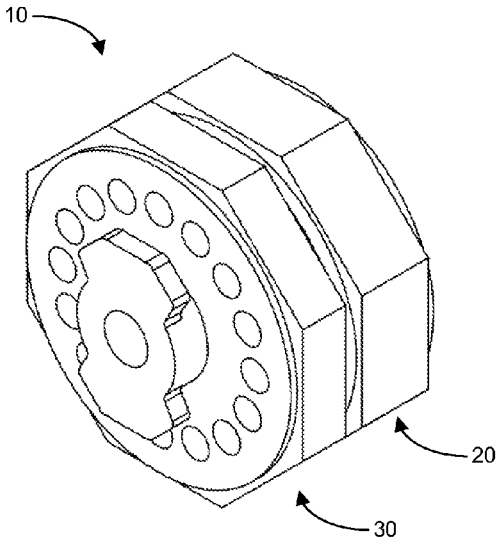
FIG. 1A is a perspective view of a firearm discharge gas flow control device in accordance with an example of the present disclosure.

These figures are provided merely for convenience in describing specific embodiments of the invention. Alteration in dimension, materials, and the like, including substitution, elimination, or addition of components can also be made consistent with the following description and associated claims. Reference will now be made to the exemplary embodiments illustrated, and specific language will be used herein to describe the same. It will nevertheless be understood that no limitation of the scope of the invention is thereby intended.

DETAILED DESCRIPTION

Reference will now be made to certain examples, and specific language will be used herein to describe the same. Examples discussed herein set forth a firearm discharge gas flow control device and associated methods that can modify flow of the gas discharged by firing a projectile from a firearm.

With the general embodiments set forth above, it is noted that when describing the firearm discharge gas flow control device, or the related method, each of these descriptions are considered applicable to the other, whether or not they are explicitly discussed in the context of that embodiment. For example, in discussing the manufactured home transportation device per se, the system and/or method embodiments are also included in such discussions, and vice versa.

Furthermore, various modifications and combinations can be derived from the present disclosure and illustrations, and as such, the following figures should not be considered limiting. It is noted that reference numerals in various figures will be shown in some cases that are not specifically discussed in that particular figure. Thus, discussion of any specific reference numeral in a given figure is applicable to the same reference numeral of related figures shown herein.

It is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an," and "the" include plural referents unless the context clearly dictates otherwise. Thus, for example, reference to "a gas chamber" includes one or more of such gas chambers.

Also, it is noted that various modifications and combinations can be derived from the present disclosure and illustrations, and as such, the following figures should not be considered limiting.

In describing and claiming the present invention, the following terminology will be used in accordance with the definitions set forth below.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Any steps recited in any method or process claims may be executed in any order and are not limited to the order presented in the claims unless otherwise stated. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

As used herein the term "suppressor" includes any device that reduces the amount of noise and muzzle flash generated by firing a firearm.

Figure 1C:
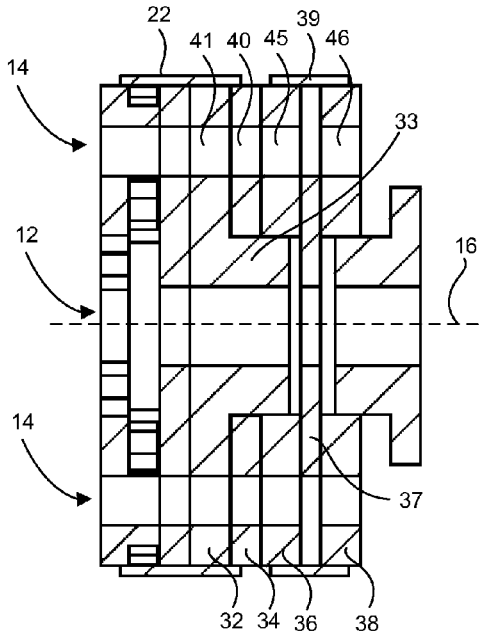
FIG. 1C is a side section view of the firearm discharge gas flow control device in FIG. 1A.
Figure 1B:
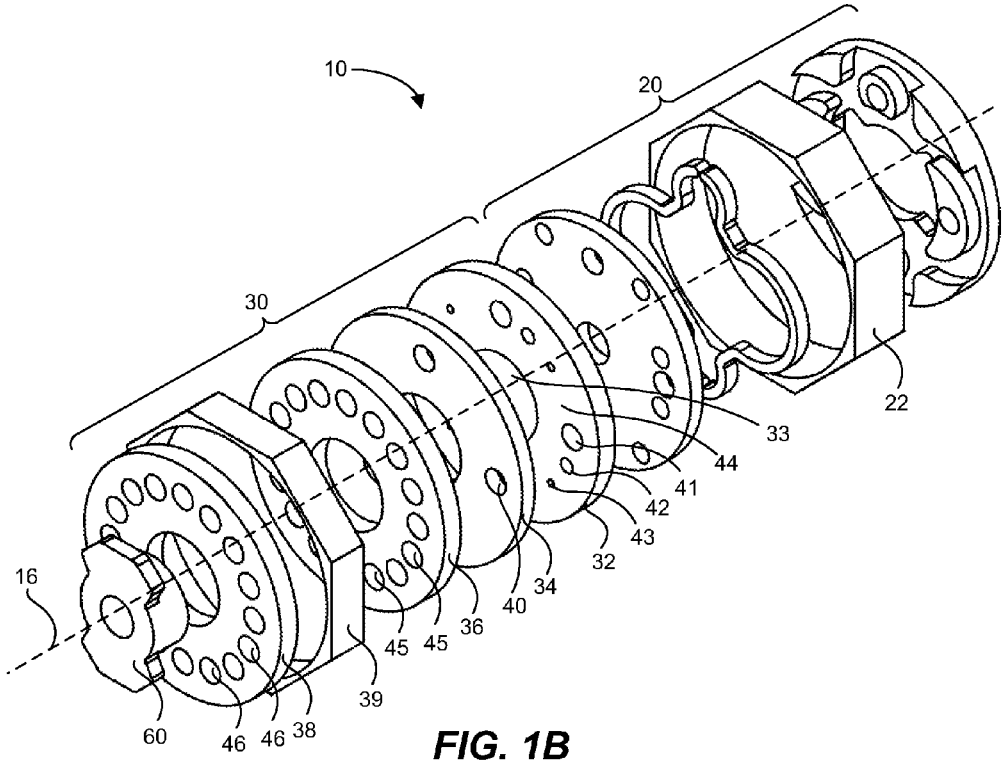
FIG. 1B is an exploded view of the firearm discharge gas flow control device in FIG. 1.

Illustrated in FIGS. 1A-1C is a firearm discharge gas flow control device 10.

The flow control device 10 can include, in general, an attachment mechanism 20 and a flow control mechanism 30. The attachment mechanism 20 can couple the device 10 to the muzzle end of a firearm or to a suppressor. An example of an attachment mechanism can include components of a coupling device found in U.S. Provisional Patent Application No. 61/418,311, filed Nov. 30, 2010 and entitled Coupling Device, System, and Methods to Maintain Relative Position between Two Components, which is incorporated herein by reference. It should be recognized, however, that any suitable attachment mechanism can be utilized, including but not limited to a threaded connection, a bayonet connection, or any other suitable type of connection.

The flow control mechanism 30 can control the flow of discharge gas through the device 10, along with particulates and other debris. In accordance with one example of the present disclosure, a variable pressure regulator is illustrated in FIGS. 1A-1C. As illustrated in FIG. 1C, the firearm discharge gas flow control device 10 can comprise a first gas chamber 12 and a second gas chamber 14. The first gas chamber 12 can be fluidly connectable to a muzzle end of a firearm to allow a projectile to pass through and to receive a first portion of a discharge gas generated by firing the projectile. The second gas chamber 14 can be fluidly isolated from the first gas chamber 12 within the gas flow control device 10. The second gas chamber 14 can be fluidly connectable to the muzzle end of the firearm to receive a second portion of the discharge gas. This is often via a suppressor (not shown) although other gas flow splitting devices can be used.

With particular reference to FIGS. 1B and 1C, the flow control device 10 can include a flow control barrier 32, a static plate 34, and a rotating plate, such as a first rotating plate 36 and a second rotating plate 38. Additionally, an outer grip ring 39 can be used to provide an interface for a user to grip the device to manipulate the adjustment mechanism to vary the flow through the device 10. The static plate 34 can be coupled to the adjustment mechanism 20 such that the flow control barrier 32 is movable relative to the static plate 34 in order to vary the flow through the device 10. For example, the second gas chamber 14 can include the flow control barrier 32 to modify a flow of the second portion of the discharge gas. In this case, the flow control barrier 32, static plate 34, first rotating plate 36, and second rotating plate 38 can define, at least in part, the first gas chamber 12 and the second gas chamber 14. For example, the flow control barrier 32, static plate 34, first rotating plate 36, and second rotating plate 38 can include apertures that form the first gas chamber 12 and the second gas chamber 14.

In one aspect, the flow control barrier 32 can be adjustable to modify gas flow through the second gas chamber 14. For example, as illustrated in FIG. 1B, the barrier 32 can comprise apertures 41, 42, 43 of different sizes to allow varying flow rates of the second portion of the discharge gas. Most often, the gases flowing through the device 10 include particulates and other debris which follow the round after discharge of the firearm. In one embodiment, the barrier 32 can be a plate rotatable about an axis 16 that is parallel to a direction of travel of the projectile. In accordance with the example shown in FIG. 1B, the barrier 32, first rotating plate 36, second rotating plate 38, and outer grip ring 39 are coupled together such that they all rotate simultaneously about the axis 16. Static plate 34, on the other hand, is coupled to the attachment mechanism 20, which is configured to be fixed relative to its attachment to a suppressor, barrel, or other component. Any or all of the various components of the attachment mechanism 20 can be disposed or contained in a housing 22. The outer grip ring 39 can be rotatable relative to the housing 22. Thus, the barrier 32 can be rotated relative to static plate 34 to align one of the different size apertures 41, 42, 43 with one of the holes 40 in the static plate 34. In this way, the discharge gas flow through the second gas chamber 14 of the device 10 can be modified or varied. The ability to vary the pressure can beneficially allow for control of gases such that timing of a chambering mechanism of the firearm can be correlated with reduction of particulates debris suspended within the gases being pulled back into the chambering mechanism. A spring, tab, latch, or other suitable feature (not shown) can be used to resist relative rotation between the outer grip ring 39 and the housing 22 to minimize the likelihood of unwanted relative rotation that would alter or adjust the flow control characteristics of the device 10.

An extension member 33 can be incorporated to couple the barrier 32 to the first rotating plate 36 to secure the barrier 32 to the static plate 34 while allowing relative rotation between the barrier 32 and the static plate 34. The extension member 33 can be configured to pass through an opening in the static plate 34, however, it should be recognized that the static plate can be disposed within an opening of the extension member 33. Additionally, the extension member 33 can be integral with, or a separate component from, either of the barrier 32 or the rotating plate 36.

The rotating plate 36 can include a plurality of apertures 45 configured to align with respective apertures 41, 42, 43 of the barrier 32. Such alignment of the apertures 45 with the apertures 41, 42, 43 of the barrier 32 can ensure that flow through the static plate from an aperture of the barrier 32 will be unimpeded by the rotating plate 36. In an alternative embodiment of a rotating plate, instead of a plurality of apertures, a single slot or opening can be sized at least as large as an outer boundary encompassing all apertures 41, 42, 43 to ensure that flow will be unimpeded by the rotating plate. In another alternative embodiment of a rotating plate, the rotating plate can have an outer diameter that is within an inner boundary of the apertures 41, 42, 43 to ensure that flow will be unimpeded by the rotating plate. In this case, the rotating plate can resemble a washer with no openings or apertures.

The rotating plate 38 can include a plurality of apertures 46 to allow gas flow to exit the device from the second gas chamber 14. As illustrated in FIG. 1C, the rotating plate 38 can be spaced from the rotating plate 36 to allow the fluid to flow from an aperture 45 aligned with the aperture 40 of the static plate 34 to at least one of the plurality of apertures 46 of the second rotating plate 38. It is noted that in practice only those apertures corresponding to openings in a subsequent module or gas exit would be uncovered. This can ensure that gas can exit the device 10 from the first rotating plate 36 regardless of the position of the apertures 45 of the first rotating plate 36. A spacer 37 can be incorporated to provide a desired spacing between the first and second rotating plates 36, 38 and provide a weld point for attachment of adjacent parts. The plurality of apertures 46 can be configured to align with a subsequent firearm muzzle-mounted device that can couple to the flow control device 10 via an attachment feature 60.

In a specific aspect, the barrier 32 can be adjustable to completely block the flow of the second portion of the discharge gas along with particulates. For example, the barrier 32 can include a solid portion 44 located between apertures, which can block the flow of discharge gas when the solid portion 44 is located in the second gas chamber 14.

On the other hand, the barrier 32 can be adjustable to allow unimpeded flow of the second portion of the discharge gas along with particulates and other debris. For example, the barrier 32 can include an aperture, such as aperture 41, that is at least as large as the smallest hole or aperture in the static plate 34, first rotating plate 36, second rotating plate 38, or other component that defines the second gas chamber 14 to allow discharge gas to pass through unhindered by the barrier 32.

Figure 2A:
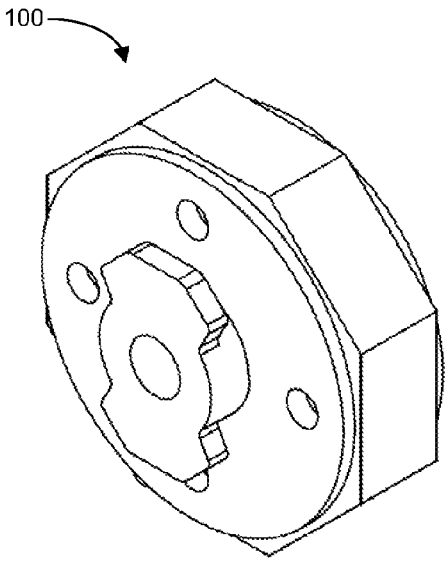
FIG. 2A is a perspective view of a firearm discharge gas flow control device in accordance with another example of the present disclosure.
Figure 2C:
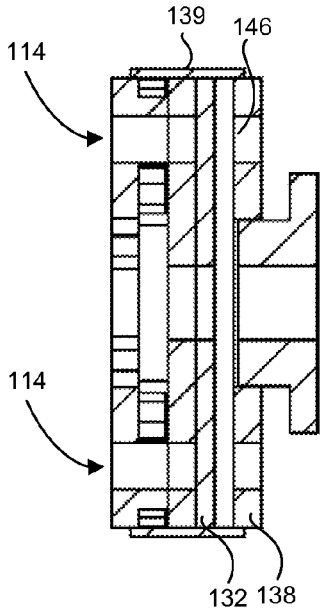
FIG. 2C is a side section view of the firearm discharge gas flow control device in FIG. 2A.
Figure 2B:
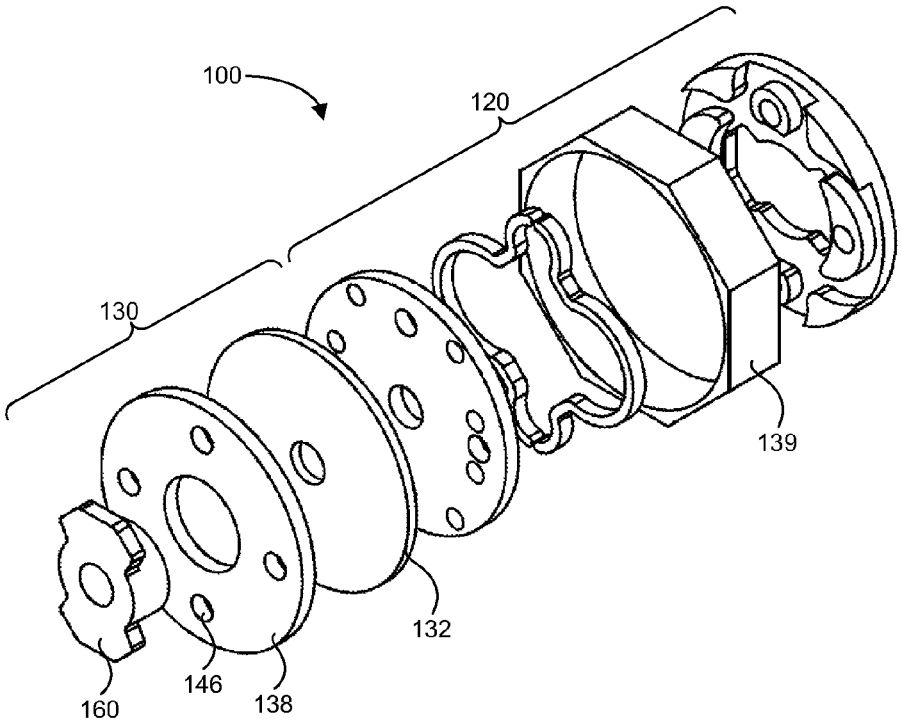
FIG. 2B is an exploded view of the firearm discharge gas flow control device in FIG. 2A.

Illustrated in FIGS. 2A-2C is a firearm discharge gas flow control device 100. As in the other examples discussed herein, the flow control device 100 can include an attachment mechanism 120 and a flow control mechanism 130. This embodiment illustrates that the flow control mechanism 130 can include a barrier 132, such as a fixed plate, that completely blocks the flow of a portion of the discharge gas through the second gas chamber 114 of the device 100. In one aspect, the barrier 132 is not adjustable. In other words, the barrier 132 cannot be oriented to allow discharge gas flow. In the embodiment illustrated, the barrier 132 is solid and does not include an aperture to allow gas flow. However, in another aspect, the barrier 132 can be removable to allow replacement with another barrier that allows discharge gas flow through the device, such as through an aperture. An attachment feature 160 can be coupled to the device 100 via an end plate 138. The end plate 138 can include an aperture or opening 146 to allow gas flow to exit the device 100 when a solid barrier is not in place or flow is otherwise allowed to pass through the second gas chamber 114. Any or all of the various components of the attachment mechanism 120 or the flow control mechanism 130 can be disposed or contained in a housing 139.

Figure 3A:
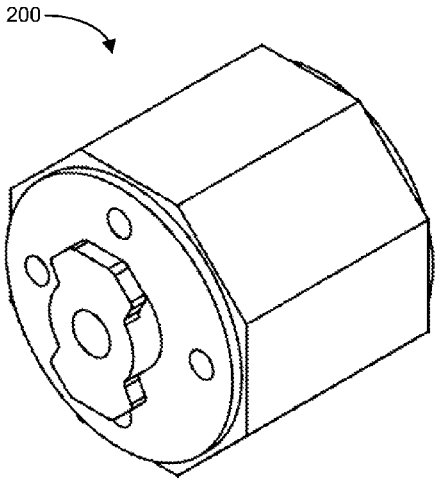
FIG. 3A is a perspective view of a firearm discharge gas flow control device in accordance with yet another example of the present disclosure.
Figure 3C:
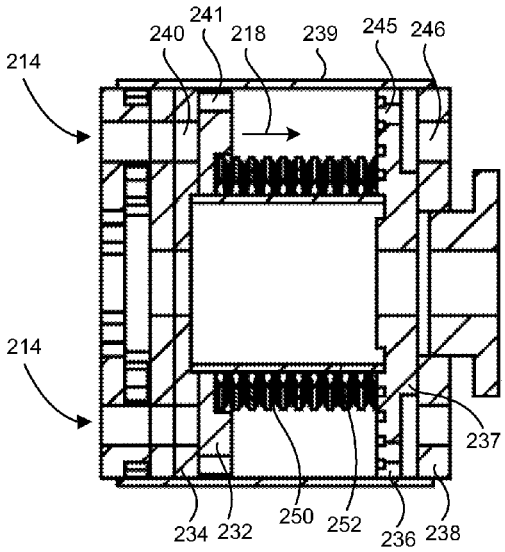
FIG. 3C is a side section view of the firearm discharge gas flow control device in FIG. 3A.
Figure 3B:
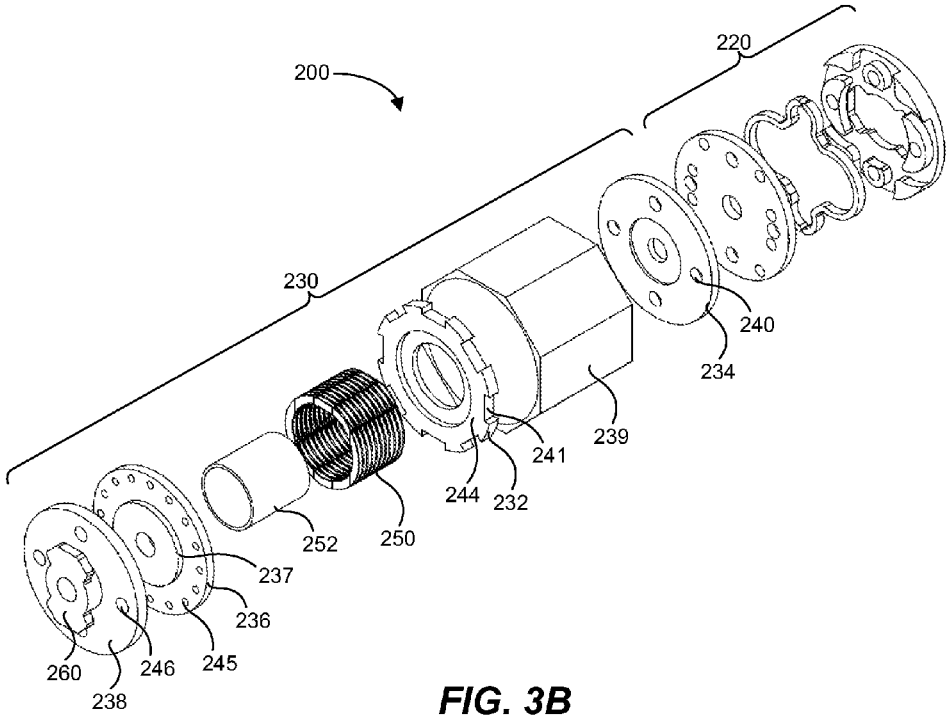
FIG. 3B is an exploded view of the firearm discharge gas flow control device in FIG. 3A.

Illustrated in FIGS. 3A-3C is a firearm discharge gas flow control device 200 utilizing a spring-loaded plate to resist gas flow through the device. As in the other examples discussed herein, the flow control device 200 can include an attachment mechanism 220 and a flow control mechanism 230. The flow control mechanism 230 can include a static plate 234 with an aperture 240. A barrier 232 can be disposed proximate to the static plate 234 such that a blocking portion 244 of the barrier 232 covers the aperture 240. The barrier 232 can include an opening or cut-out 241 configured to allow gas to flow past the barrier 232 when the blocking portion 244 is moved away from the aperture 240 of the static plate 234. As illustrated in the figures, the opening 241 is located on a perimeter of the barrier 232, however, it should be recognized that an opening can be located at any suitable location on a barrier 232.

The static plate 234 can be separated from a plate 236 by a spacer 252. The spacer 252 can be configured to pass through an opening in the barrier 232 such that the barrier 232 can move relative to the spacer 252. A spring 250 can be disposed about the spacer 252 to bias the barrier 232 against the static plate 234. For example, the spring 250 can be in contact with the plate 236 and the barrier 232 to provide a biasing force to the barrier 232. The plate 236 can include an aperture or opening 245 to allow gas to flow to past the plate 236. An attachment feature 60 can be coupled to the device 200 via an end plate 238. The end plate 238 can include an aperture or opening 246 to allow gas flow to exit the device 200. The end plate 238 can be separated from the plate 236 by a spacer 237 to allow gas to flow from aperture 245 of the plate 236 to aperture 246 of the end plate 238. In an alternative embodiment, the plate 236 can be omitted and the spacer 252 and spring 250 can interface with the end plate 238 instead. Any or all of the various components of the attachment mechanism 220 or the flow control mechanism 230 can be disposed or contained in a housing 239.

Thus configured, the barrier 232 can function as a spring-loaded plate that resists flow of a portion of the discharge gas in a second gas chamber 214 of the device 200 up to a predetermined pressure. For example, the spring 250 can be related to the barrier 232 to provide resistance to discharge gas flow into the second gas chamber 214 that encounters the barrier 232. The barrier 232 can prevent flow through the second gas chamber 214 until the pressure inside the chamber reaches a predetermined level. At this point, the spring 250 can be designed to allow the barrier 232 to move in direction 218 in response to the pressure on the barrier 232, thus allowing discharge gas to flow past the barrier 232 and through the second gas chamber 214. Typically, the spring 250 can be sufficiently weak that substantially any forward flow of gases will be allowed to pass. However, back flow would be prevented. Accordingly, in one aspect, the barrier 232 can be a movable back pressure plate having a spring 250 that biases the back pressure plate in a closed position such that the flow of the second portion of the discharge gas is allowed past the plate while back flow is substantially prevented.

It is also contemplated that a firearm discharge gas flow control device, as in any of the examples discussed above, can be included in a firearm system. For example, in accordance with the present disclosure, a firearm system can comprise a firearm and a firearm discharge gas flow control device. In one aspect, the system can further comprise a suppressor fluidly connected to the muzzle end of the firearm and to the firearm discharge gas flow control device. In a particular aspect, the suppressor can be attached directly to the muzzle of the firearm and the discharge gas flow control device can be attached directly to the suppressor. In another aspect, the suppressor can be configured to divert a portion of the discharge gas to a secondary gas chamber of the suppressor, where it is vented from the suppressor. The firearm discharge gas flow control device can be configured to capture the gas vented from the secondary chamber of the suppressor. This gas can be directed to the second gas chamber of the flow control device. The flow control device can then be used to modify the flow of the discharge gas through the second gas chamber of the device.

For example, the flow control device can be adjustable to vary the gas flow through the second chamber of the device in order to achieve a desired back pressure in the barrel for optimal reloading function of the firearm. In another example, the flow control device can completely block the flow of gas through the second chamber of the device to enhance suppression of a discharge for increased stealth.

The flow control device and internal baffles and walls can be formed of a strong material sufficient to withstand energy, sounds, gases, debris, and so forth from the high energy material. For example, the shell and/or walls can be made substantially of titanium. Non-limiting examples of other suitable materials can include high impact polymers, stainless steels, aluminum, molybdenum, refractory metals, super alloys, aircraft alloys, carbon steels, composites thereof, and the like. One or more of the individual components can further include optional coatings such as, but not limited to, diamond coatings, diamond-like carbon coatings, molybdenum, tungsten, tantalum, and the like can also be used. These components can be molded, machined, deposited or formed in any suitable manner. Currently, machining can be particularly desirable but is not required.

In a related example, and to reiterate to some degree, a method of controlling gas flow discharged from a firearm is presented in accordance with the principles herein. The method comprises disposing a firearm discharge gas flow control device proximate to a muzzle end of a firearm. The method also comprises firing a projectile from the firearm, wherein a first gas chamber of the device is fluidly connected to the muzzle end of the firearm to allow the projectile to pass therethrough and to receive a first portion of a discharge gas generated by firing the projectile, and a second gas chamber of the device is fluidly isolated from the first gas chamber and fluidly connected to the muzzle end of the firearm to receive a second portion of the discharge gas, the second gas chamber having a flow control barrier to modify a flow of the second portion of the discharge gas. The discharge gas typically includes particulates and other debris suspended within the gas. Varying gas flow through the second gas chamber allows a user to control the amount of back pressure and also tune operation of the device to the particular host firearm. Excessive back pressure can allow for increased performance of devices such as sound suppressors but can also have detrimental effects on firing mechanisms in the host firearm. A properly trained user can thus achieve customized performance based on desired results which account for both desired performance and wear on the host firearm. Adjustment of secondary gas flow can also allow for capture of debris, as well as increase or decrease visual signature reduction (e.g. visual, thermal and audio). For example, decrease of gas flow would correspondingly decrease visual, audio and thermal signatures.

In one aspect, the method further comprises adjusting the barrier to vary a flow rate of the second portion of the discharge gas, the barrier having apertures of different sizes to allow various flow rates. In a specific aspect of the method, the barrier is a plate and adjusting the barrier comprises rotating the plate about an axis that is parallel to a direction of travel of the projectile. In another aspect of the method, disposing a firearm discharge gas flow control device proximate to a muzzle end of a firearm comprises disposing the device adjacent to a suppressor. It is noted that no specific order is required in this method, though generally in one embodiment, these method steps can be carried out sequentially.

It is to be understood that the above-referenced embodiments are illustrative of the application for the principles of the present invention. Numerous modifications and alternative arrangements can be devised without departing from the spirit and scope of the present invention while the present invention has been shown in the drawings and described above in connection with the exemplary embodiment(s) of the invention. It will be apparent to those of ordinary skill in the art that numerous modifications can be made without departing from the principles and concepts of the invention as set forth in the claims.

What is claimed is:

1. A firearm discharge gas flow control device, comprising:

a first gas chamber fluidly connectable to a muzzle end of a firearm to allow a projectile to pass therethrough and to receive a first portion of a discharge gas generated by firing the projectile; and a second gas chamber fluidly isolated from the first gas chamber and fluidly connectable to the muzzle end of the firearm to receive a second portion of the discharge gas, the second gas chamber having a flow control barrier to modify a flow of the second portion of the discharge gas.

2. The device of claim 1, wherein the barrier is adjustable and comprises apertures of different sizes to allow varying flow rates of the second portion of the discharge gas.

3. The device of claim 2, wherein the barrier is a plate rotatable about an axis that is parallel to a direction of travel of the projectile.

4. The device of claim 2, wherein the barrier is adjustable to completely block the flow of the second portion of the discharge gas.

5. The device of claim 2, wherein the barrier is adjustable to allow unimpeded flow of the second portion of the discharge gas.

6. The device of claim 1, wherein the barrier is a fixed plate that completely blocks the flow of the second portion of the discharge gas.

7. The device of claim 1, wherein the barrier is a spring-loaded plate that resists the flow of the second portion of the discharge gas up to a predetermined pressure.

8. The device of claim 1, wherein the barrier is a movable back pressure plate having a spring that biases the back pressure plate in a closed position such that the flow of the second portion of the discharge gas is allowed past the plate while back flow is substantially prevented.

9. A firearm system, comprising:

a firearm; and a firearm discharge gas flow control device having a first gas chamber fluidly connected to a muzzle end of the firearm to allow a projectile to pass therethrough and to receive a first portion of a discharge gas generated by firing the projectile; and a second gas chamber fluidly isolated from the first gas chamber and fluidly connected to the muzzle end of the firearm to receive a second portion of the discharge gas, the second gas chamber having a flow control barrier to modify a flow of the second portion of the discharge gas.

10. The system of claim 9, wherein the barrier is adjustable and comprises apertures of different sizes to allow varying flow rates of the second portion of the discharge gas.

11. The system of claim 10, wherein the barrier is a plate rotatable about an axis that is parallel to a direction of travel of the projectile.

12. The system of claim 10, wherein the barrier is adjustable to completely block the flow of the second portion of the discharge gas.

13. The system of claim 10, wherein the barrier is adjustable to allow unimpeded flow of the second portion of the discharge gas.

14. The system of claim 9, wherein the barrier is a fixed plate that completely blocks the flow of the second portion of the discharge gas.

15. The system of claim 9, wherein the barrier is a spring-loaded plate that resists the flow of the second portion of the discharge gas up to a predetermined pressure.

16. The system of claim 9, wherein the barrier is a movable back pressure plate having a spring that biases the back pressure plate in a closed position such that the flow of the second portion of the discharge gas is allowed past the plate while back flow is substantially prevented.

17. The system of claim 9, further comprising a suppressor fluidly connected to the muzzle end of the firearm and to the firearm discharge gas flow control device.

18. A method of controlling gas flow discharged from a firearm, comprising:

disposing a firearm discharge gas flow control device proximate to a muzzle end of a firearm; and firing a projectile from the firearm, wherein a first gas chamber of the device is fluidly connected to the muzzle end of the firearm to allow the projectile to pass therethrough and to receive a first portion of a discharge gas generated by firing the projectile, and a second gas chamber of the device is fluidly isolated from the first gas chamber and fluidly connected to the muzzle end of the firearm to receive a second portion of the discharge gas, the second gas chamber having a flow control barrier to modify a flow of the second portion of the discharge gas.

19. The method of claim 18, further comprising adjusting the barrier to vary a flow rate of the second portion of the discharge gas, the barrier having apertures of different sizes to allow various flow rates.

20. The method of claim 19, wherein the barrier is a plate and adjusting the barrier comprises rotating the plate about an axis that is parallel to a direction of travel of the projectile.

21. The method of claim 18, wherein disposing a firearm discharge gas flow control device proximate to a muzzle end of a firearm comprises disposing the device adjacent to a suppressor.

* * * * *